US010494769B2

(12) United States Patent
Widlroither

(10) Patent No.: US 10,494,769 B2
(45) Date of Patent: Dec. 3, 2019

(54) MANUAL PACKER FOR PACKING THE BALLAST OF A TRACK

(71) Applicant: ROBEL BAHNBAUMASCHINEN GMBH, Freilassing (DE)

(72) Inventor: Otto Widlroither, Freilassing (DE)

(73) Assignee: Robel Bahnbaumaschinen GmbH, Freilassing (DE)

( * ) Notice: Subject to any disclaimer, the term of this patent is extended or adjusted under 35 U.S.C. 154(b) by 171 days.

(21) Appl. No.: 15/555,698

(22) PCT Filed: Feb. 6, 2016

(86) PCT No.: PCT/EP2016/000214
§ 371 (c)(1),
(2) Date: Sep. 5, 2017

(87) PCT Pub. No.: WO2016/138977
PCT Pub. Date: Sep. 9, 2016

(65) Prior Publication Data

US 2018/0051423 A1 Feb. 22, 2018

(30) Foreign Application Priority Data

Feb. 6, 2016 (DE) ..... 20 2015 001 706 U

(51) Int. Cl.
*E01B 27/14* (2006.01)

(52) U.S. Cl.
CPC ..... *E01B 27/14* (2013.01)

(58) Field of Classification Search
CPC ..... E01B 27/14; E01B 27/20; E01B 1/001; E01B 27/00; E01B 27/16; E01B 2203/12; E02D 3/074; E02D 3/046; A01B 1/02; A01B 1/022; A01B 1/024; A01B 1/20; A01B 1/227; E01H 5/02
See application file for complete search history.

(56) References Cited

U.S. PATENT DOCUMENTS

2013/0263755 A1* 10/2013 Widlroither ..... E01B 27/14 104/13
2013/0269563 A1* 10/2013 Widlroither ..... E01B 27/14 104/13

FOREIGN PATENT DOCUMENTS

DE 202011110462 U1 2/2014
DE 202014003655 U1 6/2014

* cited by examiner

*Primary Examiner* — Mark T Le
(74) *Attorney, Agent, or Firm* — Laurence A. Greenberg; Werner H. Stemer; Ralph E. Locher

(57) ABSTRACT

A hand tamper for tamping ballast of a track includes a drive motor for rotation of an imbalance or unbalanced weight and a barrel tip which is approximately V-shaped in longitudinal section and is fastened to a lower end of a barrel connected to the drive motor. A plurality of barrel fins extending in a longitudinal direction of the barrel are disposed on a lower barrel section adjoining the barrel tip. The barrel fins are spaced from one another relative to a barrel cross-section, extend radially from a barrel surface and are elongated into the barrel tip.

5 Claims, 1 Drawing Sheet

MANUAL PACKER FOR PACKING THE BALLAST OF A TRACK

BACKGROUND OF THE INVENTION

Field of the Invention

The invention relates to a hand tamper for tamping ballast of a track, including a drive motor for rotation of an imbalance and, fastened to a lower end of a barrel which is connected to the drive motor and has a longitudinal axis, a barrel tip which is approximately V-shaped in longitudinal section.

A hand tamper of this type is already known according to DE 20 2014 003 655.1 U and has a sleeve which is pushed onto a barrel in the longitudinal direction thereof. At the end spaced from the drive motor, the sleeve has a tamping blade consisting of two diametrically opposed blade elements projecting from the sleeve.

SUMMARY OF THE INVENTION

It is the object of the present invention to provide a hand tamper of the kind mentioned at the beginning with which an improved work result becomes possible.

According to the invention, this object is achieved with a hand tamper of the specified type by means of the features cited in the characterizing part of the main claim.

A barrel tip configured in this way offers the advantage that the vibrations produced by the imbalance can be transmitted in a significantly better manner via the barrel fins to the ballast to be tamped. The embodiment according to the invention proves particularly efficient and suitable to deliver an optimal work result especially when used in a soiled ballast bed.

Additional advantages of the invention become apparent from the dependent claims and the drawing description.

BRIEF DESCRIPTION OF THE SEVERAL VIEWS OF THE DRAWING

The invention will be described in more detail below with reference to embodiments represented in the drawing in which.

DESCRIPTION OF THE INVENTION

Figure 1:
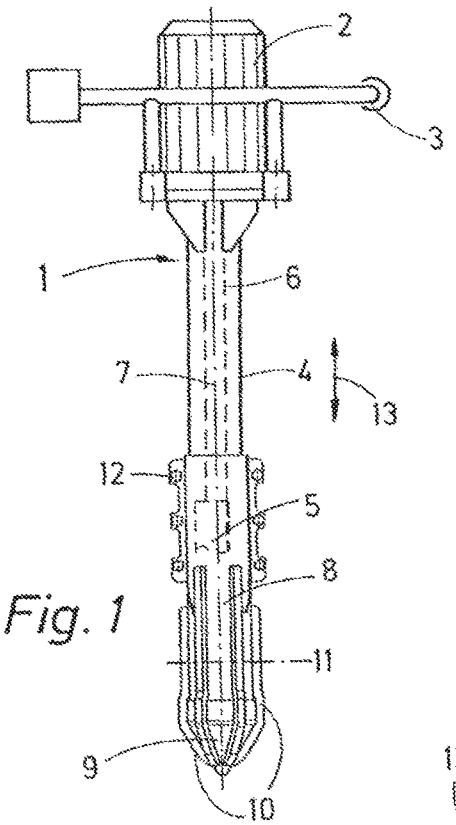
FIG. 1 shows a side view of a hand tamper having a barrel with a barrel tip.

A hand tamper 1, shown in FIG. 1, for tamping a track has a drive motor 2 which is equipped with handles 3 and connected to a barrel 4. Mounted in the latter is a shaft 6, including an imbalance 5, which can be set into rotation by the drive motor 2. At a lower end, spaced from the drive motor 2, of the barrel 4 having a longitudinal axis 7, a barrel tip 8 is fastened by means of a screw connection 12, the barrel tip being pushed onto the barrel and approximately V-shaped in longitudinal section and provided for immersion into a ballast bed of the track.

Figure 2:
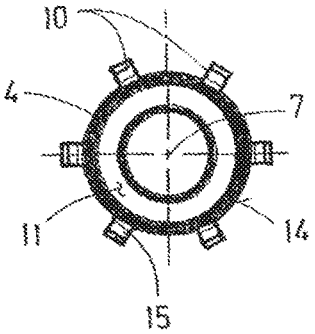
FIG. 2 shows a barrel cross-section.
Figure 3:
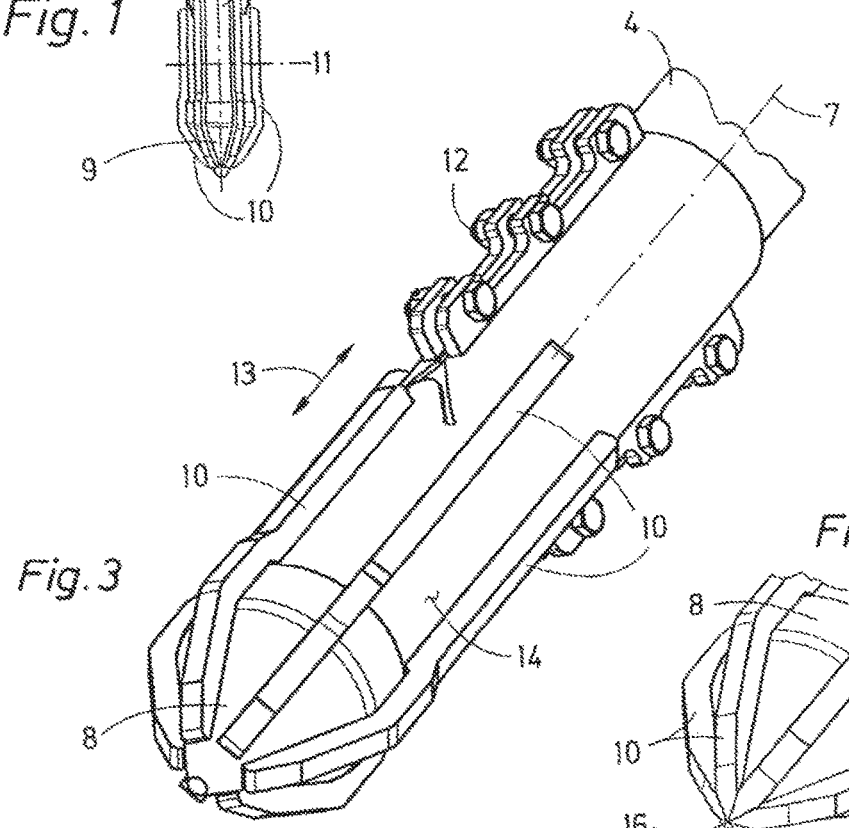
FIG. 3 shows a perspective view of the barrel tip.

As can now be seen in detail also in FIGS. 2 and 3, a plurality of barrel fins 10 are arranged on a lower barrel section 9 adjoining the barrel tip 8. The barrel fins 10—which number a total of six in the illustrated preferred example of embodiment—are arranged spaced at equal distance from one another with respect to a barrel cross-section 11 (FIG. 2) and extend in a longitudinal direction 13 of the barrel which is parallel to the longitudinal axis 7.

Figure 4:
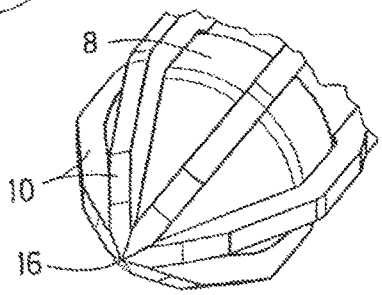
FIG. 4 shows an alternative version of a barrel tip.

As clearly visible in FIG. 2, the barrel fins 10 extending radially from a barrel surface 14 have a rectangular fin cross-section 15. At their lower end, the barrel fins 10 are designed elongated into the barrel tip 8 and chamfered. In an alternative version according to FIG. 4, the barrel fins 10 can be brought together to merge into a common fin tip 16, as a result of which the penetration resistance when immersing the hand tamper 1 into the ballast bed is reduced in a favourable manner.

The invention claimed is:

1. A hand tamper for tamping ballast of a track, the hand tamper comprising:

an imbalance;

a drive motor for rotation of said imbalance;

a barrel connected to said drive motor, said barrel having a barrel cross-section, a longitudinal barrel direction, a longitudinal barrel axis, a barrel surface, a lower barrel end, a barrel tip fastened to said lower barrel end, and a lower barrel section adjoining said barrel tip, said barrel tip having an approximately V-shaped longitudinal section; and a plurality of barrel fins disposed on said lower barrel section, said barrel fins extending in said longitudinal barrel direction, said barrel fins being spaced from one another relative to said barrel cross-section, said barrel fins extending radially from said barrel surface, said barrel fins being elongated into said barrel tip and all of said barrel fins being merged together into a common fin tip in said barrel tip.

2. The hand tamper according to claim 1, wherein said barrel fins are spaced from one another at equal distances relative to said barrel cross-section.

3. The hand tamper according to claim 1, wherein a total of six of said barrel fins are provided on said lower barrel section.

4. The hand tamper according to claim 1, wherein said barrel fins each have a rectangular fin cross-section.

5. The hand tamper according to claim 1, wherein said barrel fins are configured to transmit vibrations produced by said imbalance to the ballast to be tamped.

* * * * *